US005992610A

United States Patent [19]

Dufour et al.

[11] Patent Number: 5,992,610

[45] Date of Patent: Nov. 30, 1999

[54] METHOD AND DEVICE FOR PRODUCING A ROTATED STREAM WITH A CORNER GRIPPER

[75] Inventors: Charles Henry Dufour; Kevin Lauren Cote, both of Durham, N.H.

[73] Assignees: Heidelberger Druckmashinen AG, Heidelberg, Germany; Heidelberg Web Press, Inc., N.H.

[21] Appl. No.: 08/911,884

[22] Filed: Aug. 15, 1997

[51] Int. Cl.[6] ..... B65G 17/32

[52] U.S. Cl. ..... 198/377.06; 198/377.03; 198/377.07; 198/474.1; 271/204

[58] Field of Search ..... 198/377.02, 377.03, 198/377.07, 377.06, 470.1, 474.1, 803.3; 271/204

[56] References Cited

U.S. PATENT DOCUMENTS

| | | | |
|---|---|---|---|
| 3,587,824 | 6/1971 | Rochla | 198/377.01 |
| 3,809,214 | 5/1974 | Reist | 271/204 |
| 4,072,228 | 2/1978 | Honegger et al. . | |
| 4,550,822 | 11/1985 | Meier . | |
| 4,606,173 | 8/1986 | Meier | 271/204 |
| 4,905,818 | 3/1990 | Houseman | 198/470.1 |
| 5,112,041 | 5/1992 | Homegger | 271/286 |
| 5,433,430 | 7/1995 | Straessler et al. | 271/225 |
| 5,727,783 | 3/1998 | Tassinari | 271/204 |
| 5,740,900 | 4/1998 | Cote et al. | 198/436 |

*Primary Examiner*—William E. Terrell
*Assistant Examiner*—Khoi H. Tran
*Attorney, Agent, or Firm*—Kenyon & Kenyon

[57] ABSTRACT

A method and apparatus for processing and conveying a product stream includes a conveying belt entering a folder to grip products. The conveying belt comprises product grippers arranged thereon in an endless configuration. At least some of the grippers are selectively rotatable around an axis during movement of the conveying belt to allow for the signatures gripped to be converted into a leading corner configuration. If only a selected set of the grippers are rotated, a secondary stream of products may be formed.

20 Claims, 16 Drawing Sheets

NEED DETAILS
ON "CONVERTING
FROM OPEN EDGE
TO FOLD EDGE LEADING"

METHOD AND DEVICE FOR PRODUCING A ROTATED STREAM WITH A CORNER GRIPPER

FIELD OF THE INVENTION

The present invention relates to the transporting of signatures in a printing press and, more particularly, to a gripping and conveying system that transports signatures in a leading corner configuration.

BACKGROUND INFORMATION

In a conventional web-fed printing press, a web of material, for example, comes off a web roll into an infeed mechanism and then passes through one or more printing units followed by downstream processing units. The downstream processing units may include, among other units, a dryer, a chill unit, a slitter, a cutter, a perforator and/or a folder which includes an angle bar section, a deceleration unit, and a stacker. In the folder, individual printed products, referred to as signatures, are formed and prepared for further processing, such as binding, to form a final printed product. A sheet-fed press, on the other hand, feeds individual sheets through print units, dryers, a chill unit, and other possible processing units, before eventually folding and/or stacking the sheets. The sheet-fed press does not require a cutter in the same manner as a web-fed press which requires the web to be cut for processing, however, both types of presses transport signatures as a stream of printed products during press operation.

A stream of printed products may be gripped by a gripper conveyor as is commonly known in the art. It is often desirable to process this stream of products by, for example, splitting it into two or more separate streams or some other processing such as conveying and stacking. The conventional method of splitting a stream of products, especially printed products, is to drag the initial stream over a vacuum belt traveling slower than the conveying system and to release every other (i.e., second) signature from a gripper conveyor as soon as the respective signature contacts the vacuum belt. However, this often results in relative movement between those signatures delivered onto the vacuum belt and those signatures which remain gripped by the conveying system. Consequently, correct alignment and fixed pitch (the distance between like points of two consecutive signatures in a product stream) of the signatures delivered to the vacuum belt cannot be guaranteed.

A number of patents purport to describe grippers which are used for transporting signatures and for purposes other than splitting a product stream. For example, U.S. Pat. No. 4,550,822 purports to disclose an apparatus for transporting flat products, especially printed products. In this configuration each gripping unit comprises a stationary clamping jaw, a pivotable clamping jaw and a plate shaped stop. The pivotable clamping jaw is pivoted against the action of a closing spring by a cam structure or the like. The products are first accelerated and then pushed into the open gripper mouth until they abut the stop so that the printed products are aligned at the region of their leading edges. At their trailing edges the printed products remain under the conveying action of the belt conveyor at least until the gripper units are closed.

U.S. Pat. No. 4,072,228 purports to show an apparatus for evening a stream of printed products. This apparatus comprises a number of revolving entrainment members being in a drag connection with one another. At the region of their conveying action path the entrainment members are guided and at the start of their path driven by a thrust drive and at the end thereof driven by a traction drive. The entrainment members engage the printed products and the thrust and traction drives cause a change in the spacing of the entrainment members and consequently, in the spacing of the products.

U.S. Pat. No. 3,809,214 purports to disclose a turning conveyor for flat structures, especially printed products. This turning conveyor encompasses a plurality of entrainment members which move along with the flat structures and each of which can be brought into engagement with a respective one of the flat structures. The entrainment members are controlled such that at least at the time they are in engagement with a flat structure they carry out a relative movement with regard to the direction of movement of the main conveyor in order to turn the flat structures about an axis being perpendicular to the flat structures. In addition, gripper conveyors, such as the type described in co-pending application U.S. Ser. No. 08/504,868, filed Jul. 20, 1995, which is incorporated herein by reference, transport signatures for processing in a printing press.

Several other approaches have been attempted to reduce or eliminate problems associated with handling the signatures in a printing press, but none have been entirely successful. One attempted solution, for example, was to grip signatures individually in a leading edge configuration, however, problems remained with aerodynamic and mechanical disturbances causing handling and transporting difficulties. For example, lift and drag forces can operate upon signatures being transported to, for example, lift the edge of a signature and fold the edge back or separate pages of the signature.

SUMMARY OF THE INVENTION

In accordance with the present invention, a method and apparatus are provided for gripping a signature of a product stream at a corner of the signature and transporting the signature in a configuration wherein the gripped corner is the leading part of the signature, the apparatus comprising a single conveying belt having a plurality of grippers traveling along a single conveyor path. The grippers are capable of gripping the signatures at a corner thereof and thereafter, the grippers can maneuver into a position whereby the gripped corner is leading the signature to thereby place the product stream in a leading corner or "A-angle" configuration. Each of the grippers may be capable of rotating a product in a range of approximately 30 to 60 degrees to thereby create a product stream having a leading corner configuration. For example, a rotation of 45 degrees creates a leading corner configuration in which the two frontal sides of the signature create a 45 degree angle with a line perpendicular to the direction of travel.

According to the present invention, it is also possible to have only some of the grippers rotate while other grippers remain unrotated. In this manner, the stream can be split so that some of the products are removed to a secondary product stream while some products remain in the initial product stream. It is also noted that a gripper might provide for various amounts of rotation. As discussed, the gripper may rotate in a range of approximately 30 to 60 degrees to attain a leading corner configuration. Additionally, however, a gripper may rotate in a greater range, for example from approximately 120 to 150 degrees to thereby rotate an alternative corner into the leading corner position. For example, consider a rotating gripper that grips a corner on the leading edge of a signature stream. With a 45 degree rotation, one of the corners of the leading edge of the initial product stream becomes the leading corner. With a 135 degree rotation, however, one of the corners on the trailing edge of the initial product stream can become the leading corner.

Whether products are selectively rotated to thus be removed from the initial product stream into a secondary product stream or are all rotated together into a single leading corner product stream, the products can remain within a substantially horizontal conveying plane during rotation according to the present invention. This prevents damage to the product during movement out of the initial product stream and into the rotated or secondary product stream. Furthermore, when a secondary product stream is created, a second conveying belt is not necessary since the rotatable grippers create the secondary product stream while still being conveyed along a single conveying path. Moreover, transport of the stream of signatures in a leading corner configuration provides improved aerodynamics, mechanical and dynamic effects, thereby minimizing lift and distortion of the signatures during transport.

In the method and apparatus according to the present invention, the individual grippers can be actuated individually, thus a whole variety of product splitting patterns can be achieved, such as releasing or inserting selected products, wherever needed. Moreover, the pitch and alignment of the secondary product stream is assured, because the products of the secondary stream need not be dropped onto a vacuum belt, which can lead to distortions of pitch.

In accordance with a first embodiment of the present invention, the products in the initial product stream are conveyed so that they extend substantially on one side of the conveying path. The products can then be collectively or selectively rotated by an appropriate amount to place the selected products into a leading corner configuration and kept substantially within the same horizontally extending plane. This reduces the space requirements of the conveying belt, as compared to prior art systems which required secondary belts, and provides improved transportation characteristics for the rotated product stream.

In accordance with a second embodiment of the present invention, a positive control mechanism may be located on the side of the conveying path to positively grip and receive the products of the secondary stream. After entry of the products into the positive control mechanism, the grippers release the products, and a fixed pitch and correct alignment for the secondary stream are assured because the products are under constant control during rotation and transfer. In accordance with a third embodiment of the present invention, a similar device also may transfer products remaining in the initial product stream.

In accordance with a further embodiment of the present invention, a continuous product conveyance is achieved by providing individual grippers linked to one another throughout the single conveying path. Depending on different requirements, the single conveying path can have a first, a second, a third, or more groups of grippers—the members of each group capable of being actuated individually.

In accordance with a still further embodiment of the present invention, each gripper includes a gripper head which is rotatable about a rotation axis, and which includes a movable lower portion for gripping and releasing the products. A first actuator is provided for moving the movable lower portion between a release position and a closed position. The first actuator can be, for example, a first actuating pin coupled to a spring mechanism, a hydraulic mechanism, a pneumatic mechanism, or other appropriate device for moving the movable lower portion of the gripper head. A second actuator is provided for rotating the gripper head between a first position (e.g., holding products in the initial product stream) and a second position (e.g., holding products in the secondary product stream). The second actuator can be, for example, a second actuating pin coupled, for example, to a spring mechanism, a hydraulic mechanism, a pneumatic mechanism, an electrically controlled motor, or other appropriate device for rotating the gripper head.

In addition to rotating the gripper about its axis to place the signatures in a leading corner configuration, an alternative procedure includes gripping a shingled product stream with corner grippers on one of the corners of the leading edge. Thereafter, rather than conveying along a substantially straight path and rotating the gripper, the conveying path direction may be changed by an angle of approximately 30 to 60 degrees. Thereby, the signature stream is conveyed in a leading corner configuration.

BRIEF DESCRIPTION OF THE DRAWINGS

FIG. 2(*b*) shows a front view of a portion of a conveying belt;

FIG. 2(*c*) shows a top view of a portion of the conveying belt;

FIG. 3(*b*) shows a top view of one of the grippers;

FIG. 3(*c*) shows a perspective view of one of the grippers further showing a cut-away view of the detail of the rotation and clamping mechanism according to an embodiment of the present invention;

FIG. 3(*d*) shows a perspective view of the grippers further showing a cut-away view of the detail of the rotation and clamping mechanism according to a second embodiment of the present invention;

FIG. 4(*b*) shows the movement of those products selectively rotated out of their original conveying position into a leading corner configuration according to the present invention (but not showing the signatures that were not selected for rotation);

DETAILED DESCRIPTION OF THE INVENTION

Figure 1:
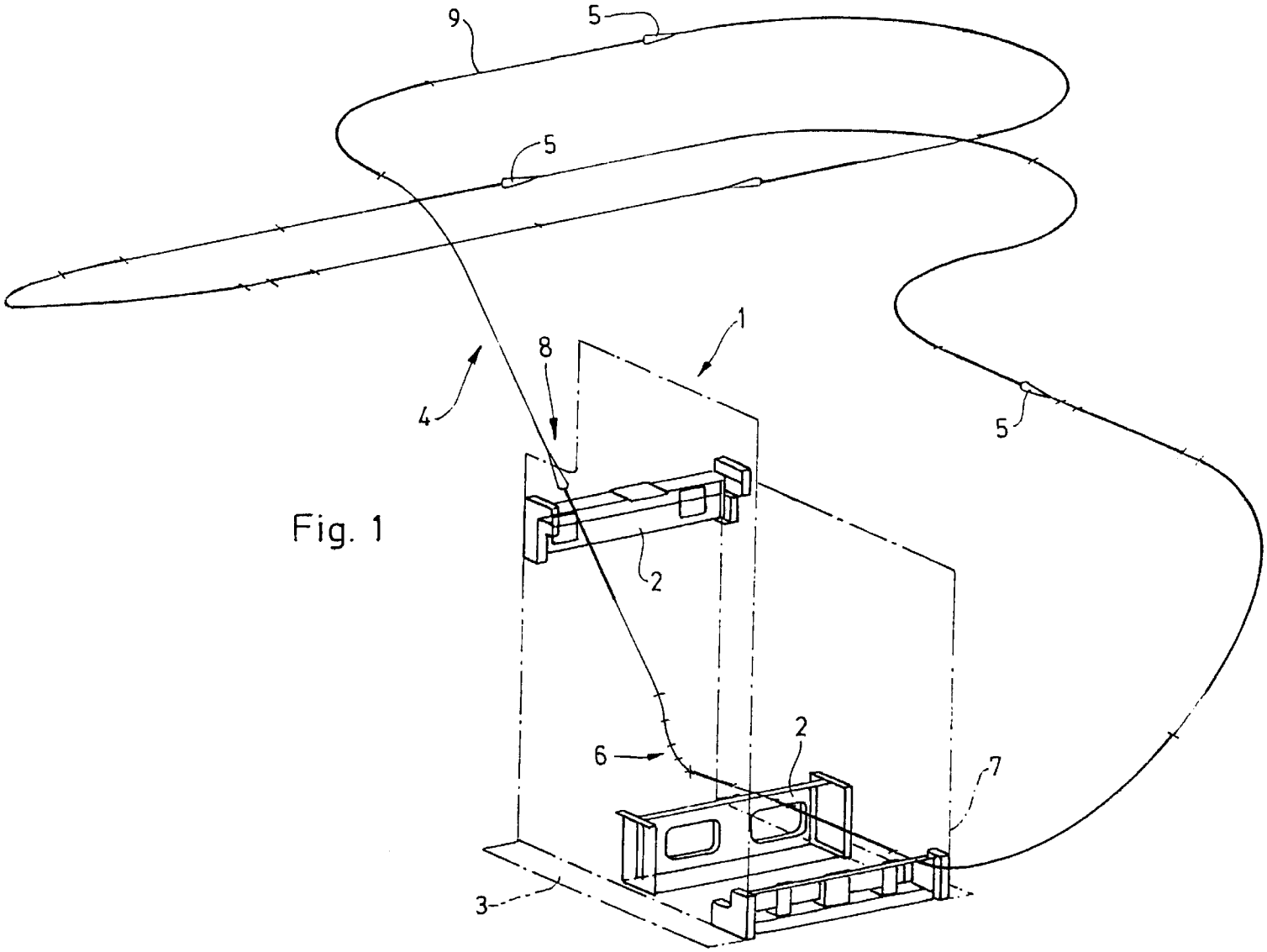
FIG. 1 shows a schematic view of a conveying path for products emerging from a folder according to an embodiment of the present invention.

FIG. 1 shows a conveying path 4 for sheet-like products. A folder 1 has two frames (shown schematically) bridged by traverses 2. The folder 1 is of any well known type which delivers products or signatures. The frame of the folder 1 is raised, for example, upon a base 3 on the floor of a print shop. The folder 1 has a product transfer section 6 where products delivered by the folder 1 are seized by a conveying belt 9 with grippers (not shown). This conveying belt 9 passes an exit section 8 of the folder 1 and conveys the gripped products along the conveying path 4 in conveying direction 5.

After the seized products have been delivered at different release stations to bindery facilities or have been inserted into printed material, i.e., newspapers, journals or the like, the conveying belt reenters the folder 1 via entry section 7.

Figure 2A:
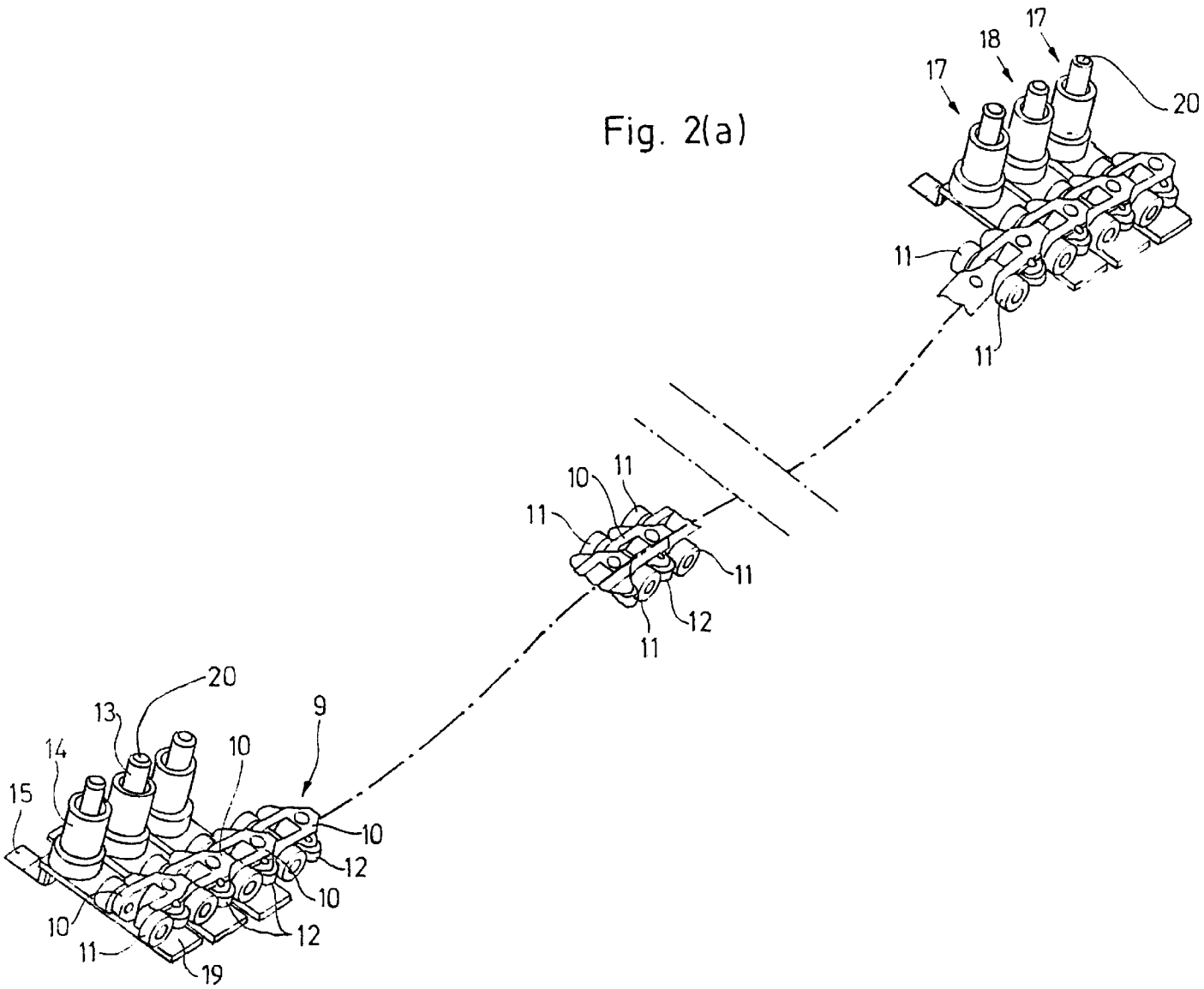
FIG. 2(*a*) shows a plurality of grippers traveling along the conveying path according to an embodiment of the present invention.
Figure 2B:
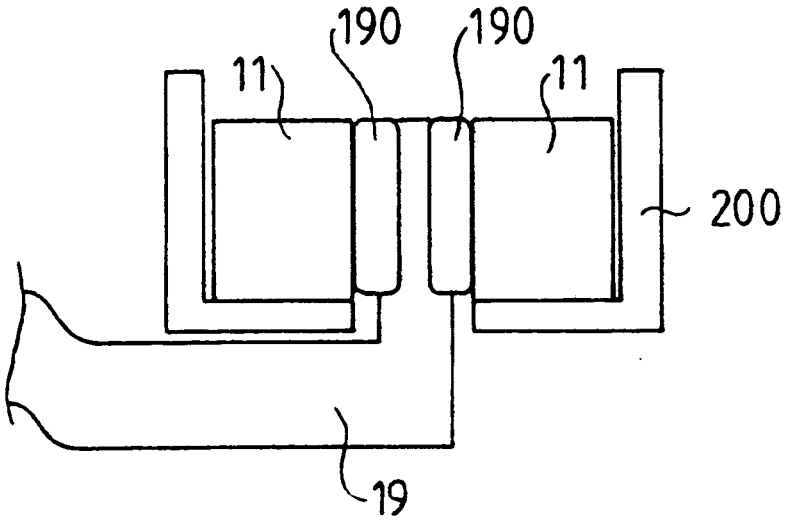
Figure 2C:
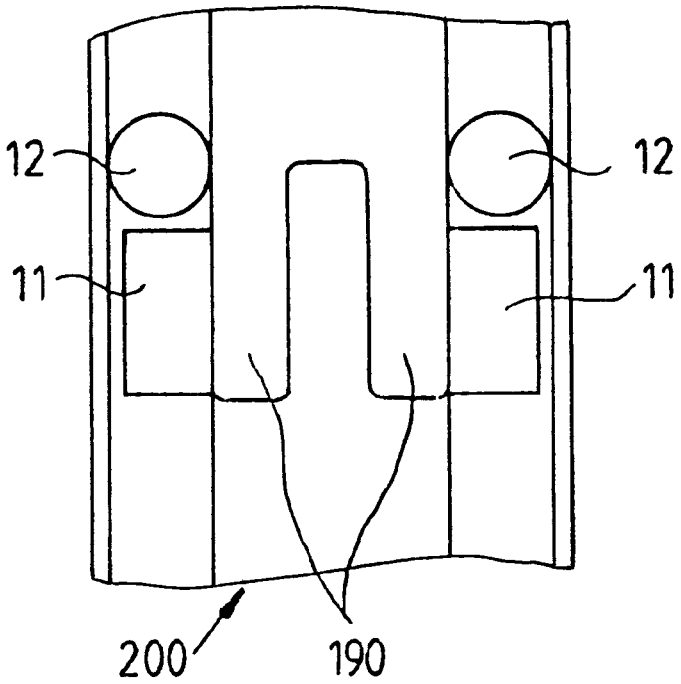
Figure 3A:
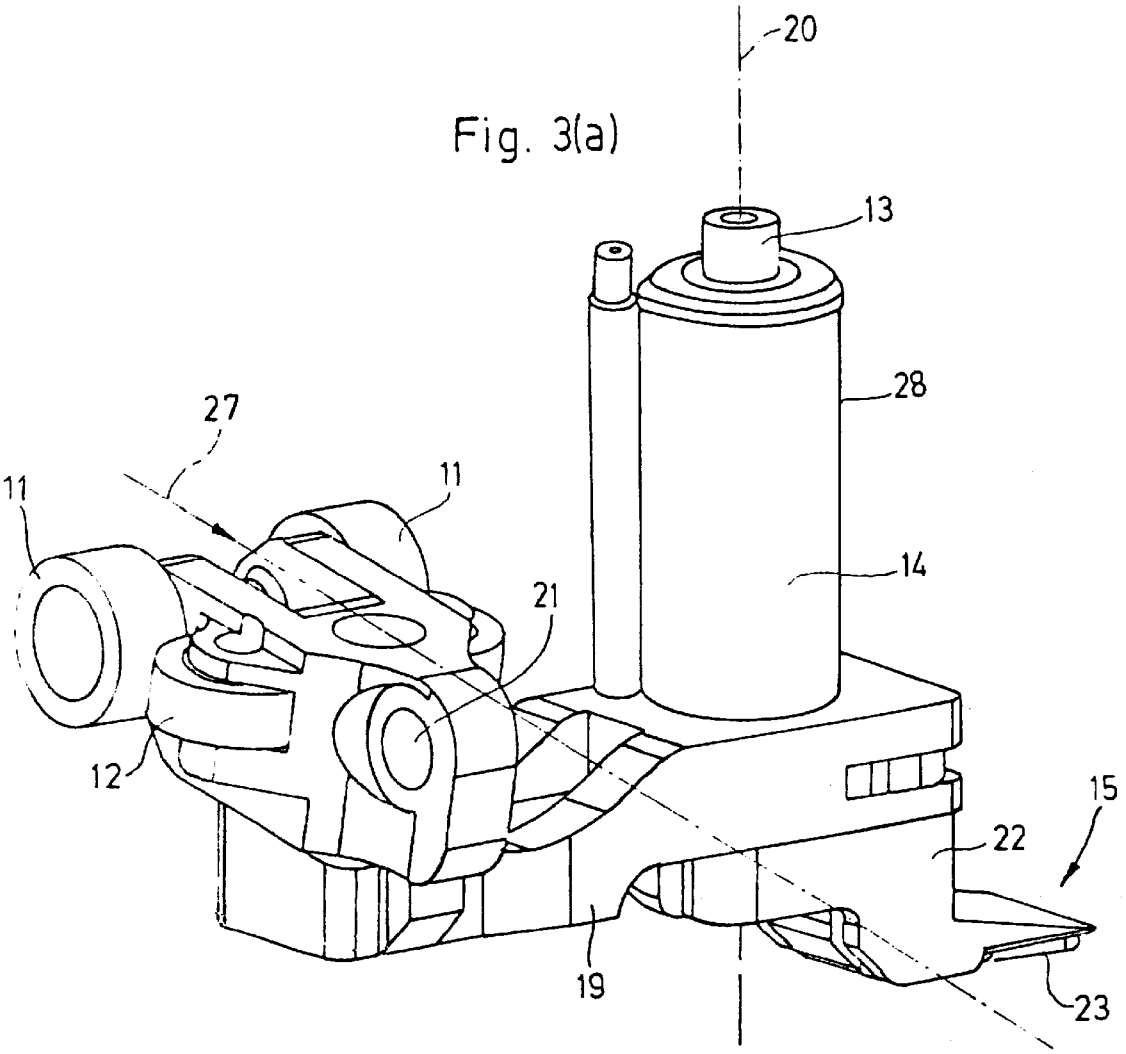
FIG. 3(*a*) shows a perspective view of one of the grippers in the conveying belt according to an embodiment of the present invention.
Figure 3B:
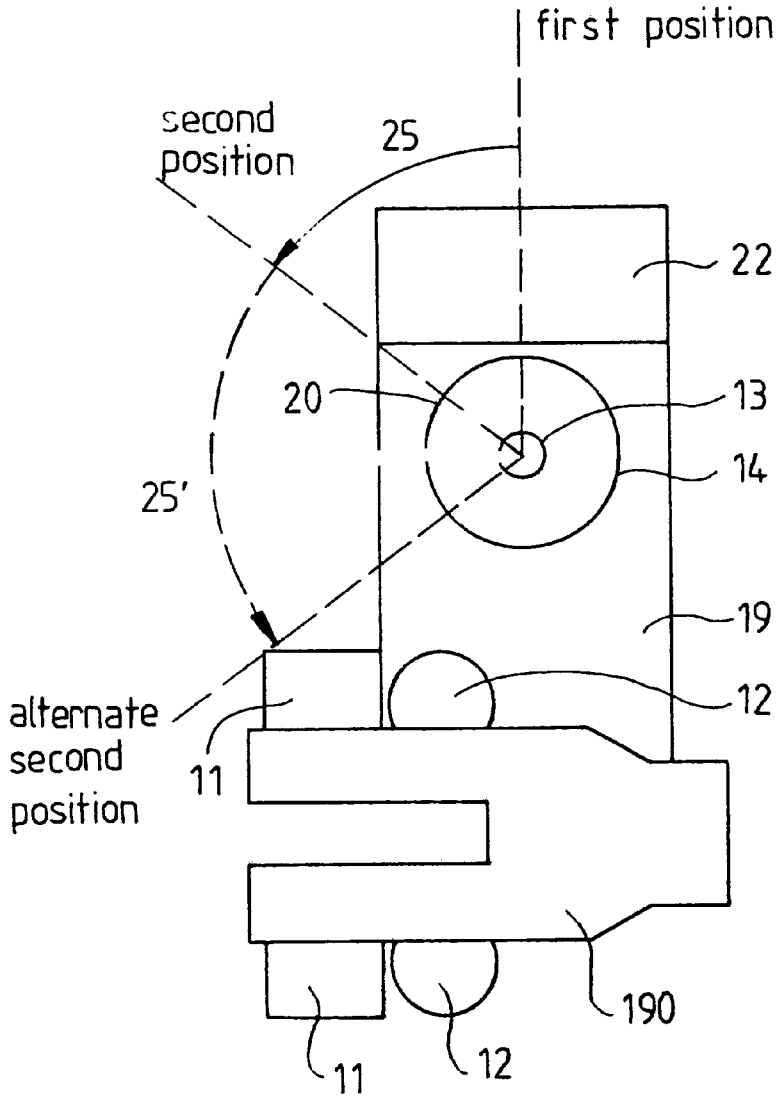
Figure 3C:
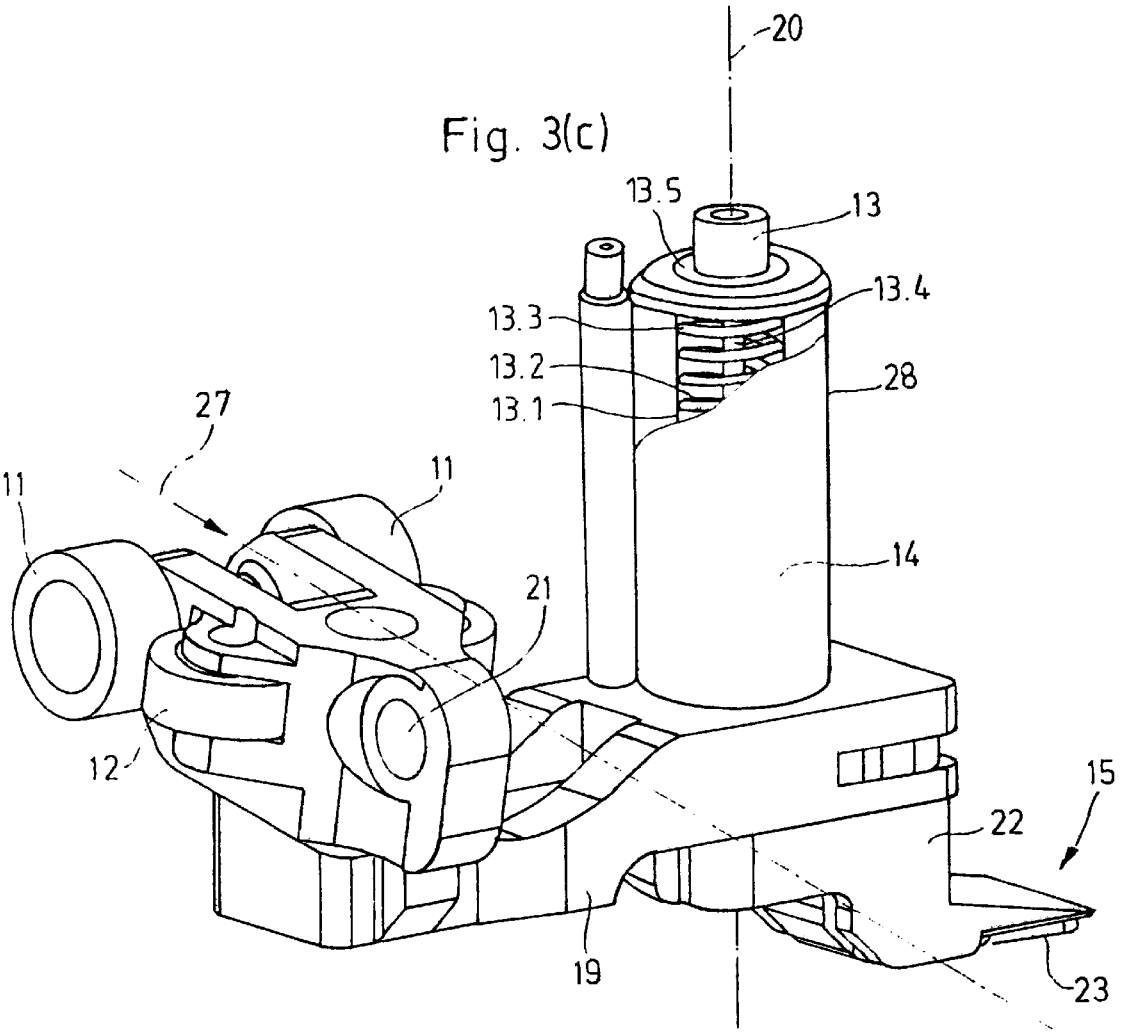
Figure 3D:
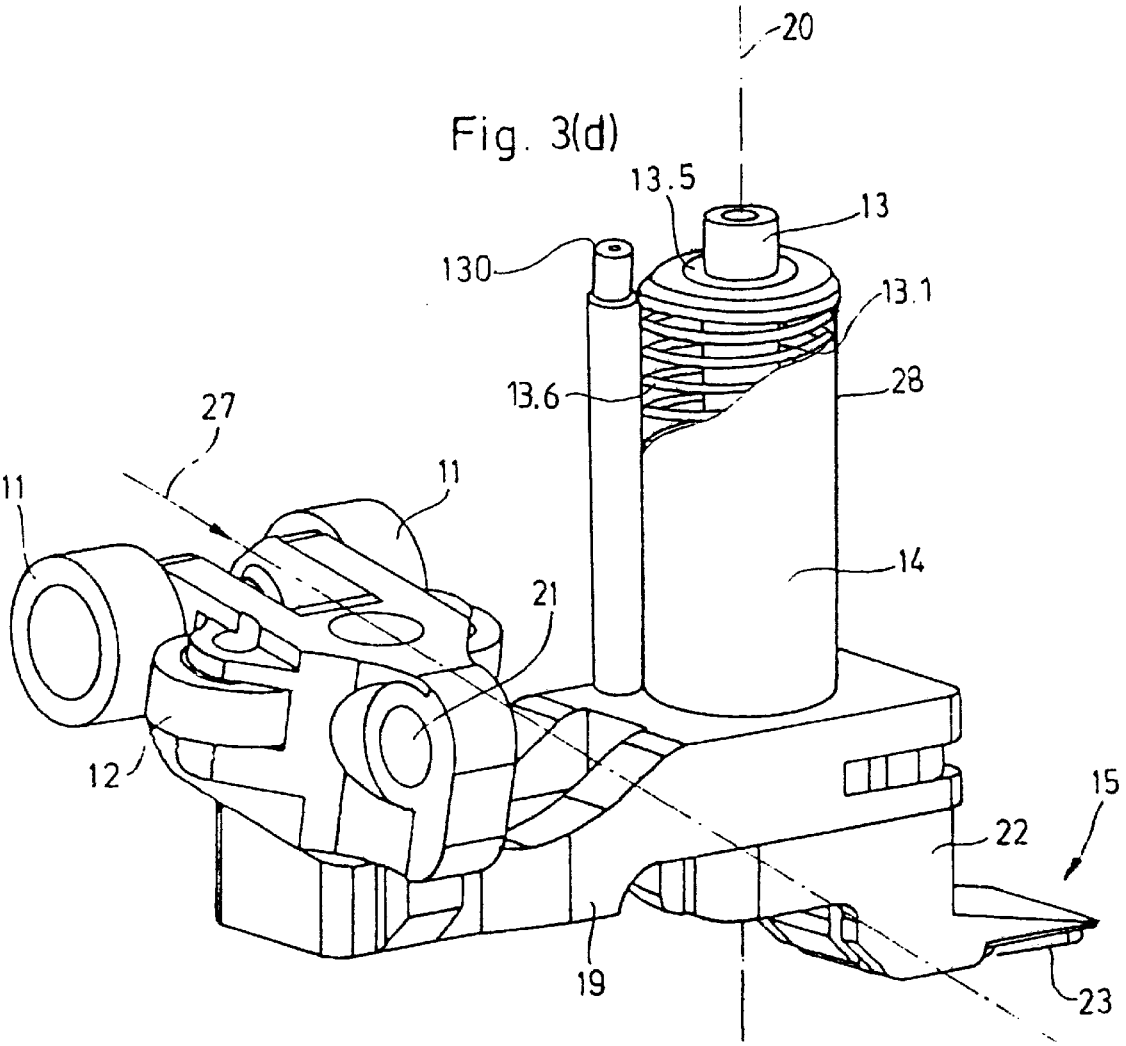

FIGS. 2(*a*)–(*c*) show an exemplary embodiment of the conveying belt 9 in greater detail. As shown in FIG. 2(*a*), a single conveying belt 9 comprises, for example, grippers 10, which are linked to one another. The grippers 10 have guide rollers 11, 12 mounted on a U-shaped housing 190 to keep the conveying belt 9 following the path of a stationary conveying track 200, which, for example can be constructed in an L-shaped configuration. Referring to FIGS. 2(*b*) and 2(*c*), the guide rollers 11 are in rolling engagement with the horizontal portion of the stationary conveying track 200, while the guide rollers 12 are in rolling engagement with the vertical portion of the stationary conveying track 200. Each of the grippers 10 is equipped with a first actuating pin 13, which is pretensioned by a spring 13.3 (not shown). The actuating pin 13 activates a moveable portion of a product gripper head 15, for selectively gripping and releasing a product which is held by the gripper 10. As shown schematically, each of the grippers 10 includes a support 19, extending perpendicularly with respect to the conveying direction. On the support 19, the gripper head 15, the spring 13.3, and the actuating pin 13 are mounted, as shown in detail in FIGS. 3(*a*)–(*d*).

In the exemplary configuration shown in FIG. 2(*a*), the conveying belt 9 comprises a first set 17 of grippers 10, hereinafter called A-grippers and a second set 18 of grippers 10 hereinafter called B-grippers. It is readily apparent that a third, a forth, or more species of grippers can easily be defined. To explain the principle it is, however, sufficient to define an A-gripper set 17 and a B-gripper set 18. As shown in FIG. 2(*a*), the grippers 10 have a rotation axis 20, about which the gripper head 15 is pivotable.

FIGS. 3(*a*)–(*d*) show an exemplary gripper 10 according to the present invention in greater detail. The gripper 10 is being transported in conveying direction 27 and is guided via guide rollers 11, 12 along the conveying track 200 in a conventional fashion. The rotation axis 20 extends, for example, perpendicular to the conveying direction 27, thus allowing the gripper head 15 to rotate. The rotational movement of gripper head 15 extends, as shown, approximately 45 degrees through the given angle 25 as shown in FIG. 3(*b*), but can also be adjusted to accommodate other rotational positions. For example, rotation of the signatures so that the edge forms an angle in a range of approximately 30 to 60 degrees with respect to the direction of travel of the signatures according to the present invention can improve the transportation characteristics of the signatures. Additionally, rotations in excess of 135 degrees, as indicated by alternate second position having a rotational angle 25' as shown in FIG. 3(*b*), provide for alternate leading corner configurations. For example, a rotation of approximately 45 degrees can put a first corner in the leading corner position. Continued rotation of an additional 90 degrees (for a total of approximately 135 degrees) could place a corner adjacent to the first corner in the leading corner position.

FIG. 3(*c*) shows a cross-section through a portion of the gripper 10. The first actuating pin 13 is linked with a moveable portion 23 of a product gripper head 15 via a rod 13.4. A stationary portion 22 of the product gripper head 15 is mounted to the support 19. By applying pressure to the first actuating pin 13, the moveable portion 23 of the gripper 10 is moved downward releasing a product held between the stationary portion 22 and the moveable portion 23. Within a housing 13.1, a spring 13.3 is pretensioned between an upper support 13.5 and a lower support 13.2, the upper support 13.5 mounted to the rod 13.4. When pressure is applied to the actuating pin 13, and the rod 13.4 moves the movable portion 23 downward as described above, the spring 13.3 compresses. Once pressure is removed from the rod 13.4, the compressed spring expands, moving the movable portion upward towards the stationary portion 22.

Referring to FIG. 3(*d*), on the support 19, a pretensioning device such as a spring 13.6 is mounted for facilitating the rotational movement of the gripper head 15. A second actuating pin 130 is provided for actuating rotational movement of the gripper head 15 about the axis 20. Just prior to the entry section 7 (see FIG. 1), a cocking mechanism (e.g., a post appropriately mounted in the path of the gripper head 15) engages the gripper head 15 and rotates it into a first (cocked) position as shown in FIG. 3(*b*). In the first position, the spring 13.6 is held in tension by an actuation device (e.g., a tab holding one end of the spring 13.6). When the second actuating pin 130 is subsequently pressed, it causes the actuating mechanism to release the spring 13.6 from tension and the gripper head gradually rotates counterclockwise along the angle 25 into the second (rotated) position as shown in FIG. 3(*b*). As described in more detail below, triggering of the second actuating pin 130, as well as triggering of the first actuating pin 13, can be accomplished by actuating mechanisms 340 (not shown) in a variety of ways. For example, the release of spring 13.6 could provide both 45° and 135° rotation, although rotation back to the cocked position for the 135° rotation would require, for example, rotary motion via a gear set (not shown).

While the rotation of the gripper head 15 has been described above with respect to a spring actuated mechanism, it should be clear that other rotation mechanisms are also acceptable. For example, rotation of the gripper head 15 could be accomplished with conventional hydraulic or pneumatic mechanisms. Alternatively, an electrically controlled motor could be used. Moreover, it should be clear that the gripper head 15 can be returned to the first position under the control of a pneumatic, hydraulic, or electrically controlled mechanism. Rotation from the second position to the first position could then be triggered, for example, by providing an additional actuating pin, or by toggling the actuating pin 130. Similarly, while the actuating pin 13 is illustrated as opening the gripper 15 by means of a spring mechanism, it should be clear that a hydraulic or pneumatic mechanism, or any other suitable device, could also be used. The gripper mechanism according to the present invention as shown in FIGS. 3 (*a*)–(*d*) grips and conveys signatures in an overlapping stream configuration. The gripper mechanism has gripper jaws designed, for example, to grasp a corner of a signature. Multiple gripper mechanisms are joined, for example, in a chain link configuration, as is known in the art, in order to convey a continuous stream of signatures.

Figure 4A:
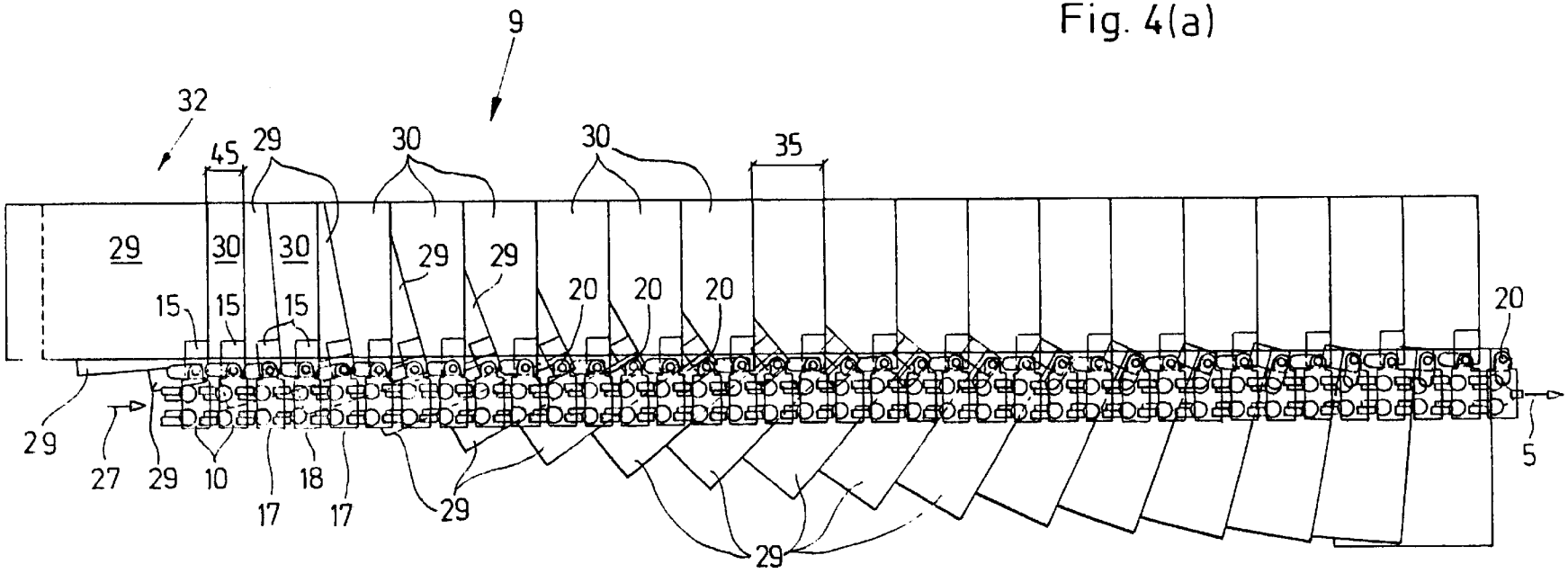
FIG. 4(*a*) is a view of a shingled product stream from which products may be selectively taken by grippers rotated from the original orientation and separated from the initial product stream according to the present invention.
Figure 4:
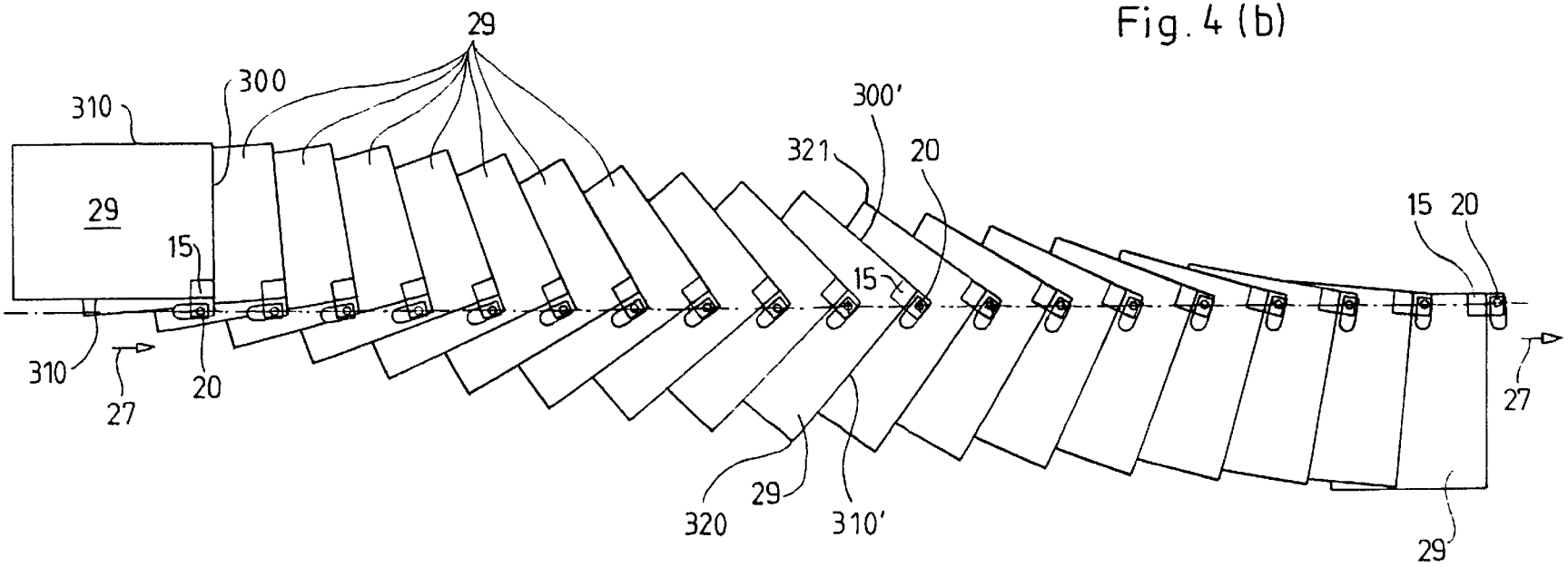

FIG. 4(*a*) is a view of a shingled product stream from which products are selectively taken. The conveying belt 9 transports a stream of shingled products 32, including products 29, 30 which move in conveying direction 27 along the conveying path 5. Each of the products 29, 30 is gripped by a gripper head 15.

As described above, the grippers 10 each have a rotation axis 20 allowing the gripper head 15 to rotate. For clarity, FIG. 4(*a*) shows a set 17 of A-grippers and a set 18 of B-grippers, the A-grippers 17 and B-grippers 18 gripping a product stream 29 and 30 respectively. The B-grippers 18 can, for example, remain substantially in their position relative to the conveying direction 27, thus keeping the products 30 in a fixed pitch on one side of the conveying track. The products 29, each fixed by an A-gripper 17, however, can be rotated around the axis 20 thus leaving the shingled formation of the product stream. After a rotation of, for example, approximately 45 degrees, the products 29 of the A-grippers 17 acquire a leading corner configuration with the gripped corner being the leading part of the signature. The former leading edge of the products 29 becomes one side edge and the original side edge consequently becomes a second opposed side edge, the side edges trailing back from the leading corner, as will be seen and discussed more fully in reference to FIG. 4(*b*) below. The leading corner stream is now offset to the side of the original conveying track.

In this way, the portion of the product stream gripped by the A-grippers 17 is changed to a leading corner configuration and is also split from the original stream. Each of the two streams having a new fixed pitch as a result of the rotation of the A-grippers 17. Referring to FIG. 4(*a*), prior to selective rotation of the A-grippers 17, the single product stream has a pitch 45 between products 29, 30. After selective rotation of the A-grippers 17, the stream of products 30, as well as the stream of products 29, each have a pitch 35 between products.

FIG. 4(*b*) shows only those products of FIG. 4(*a*) which are selectively rotated out of the original conveying position, so that the 45 degree movement may be more clearly seen. The dashed line, extending in conveying direction 27, indicates the centers of the rotation axes 20, which are being conveyed substantially parallel to the conveying path 4 in a defined position. The gradually performed rotation of a selected product 29 can be seen. Upon completion of the rotational movement, the selected products 29 have accordingly changed their conveying position to a leading corner or "A-angle" configuration. Before rotation, the product 29 has a leading edge 300 and a side edge 310. After rotation, the former leading edge 300 becomes one of the frontal side edges 300', and the former side edge 310 becomes the other frontal side edge 310', each side edge trailing back from the leading corner.

As can further be seen in FIG. 4(*b*), the leading corner configuration provides for two exposed opposed corners 320, 321. One exposed opposed corner lies on each side of the leading corner and is arranged slightly downstream of the leading corner. By gripping the leading corner and transporting at an A-angle, dynamic disturbances of the signature stream are minimized. The A-angle further provides improved access for gripping the sides 300', 310' adjacent the leading corner, and the two exposed opposed corners 320, 321 for further manipulation of the signature stream. For example, the leading corner configuration provides improved access of the stream of signatures for additional gripper conveyors to grasp a signature for diverting or stream separation.

Figure 5:
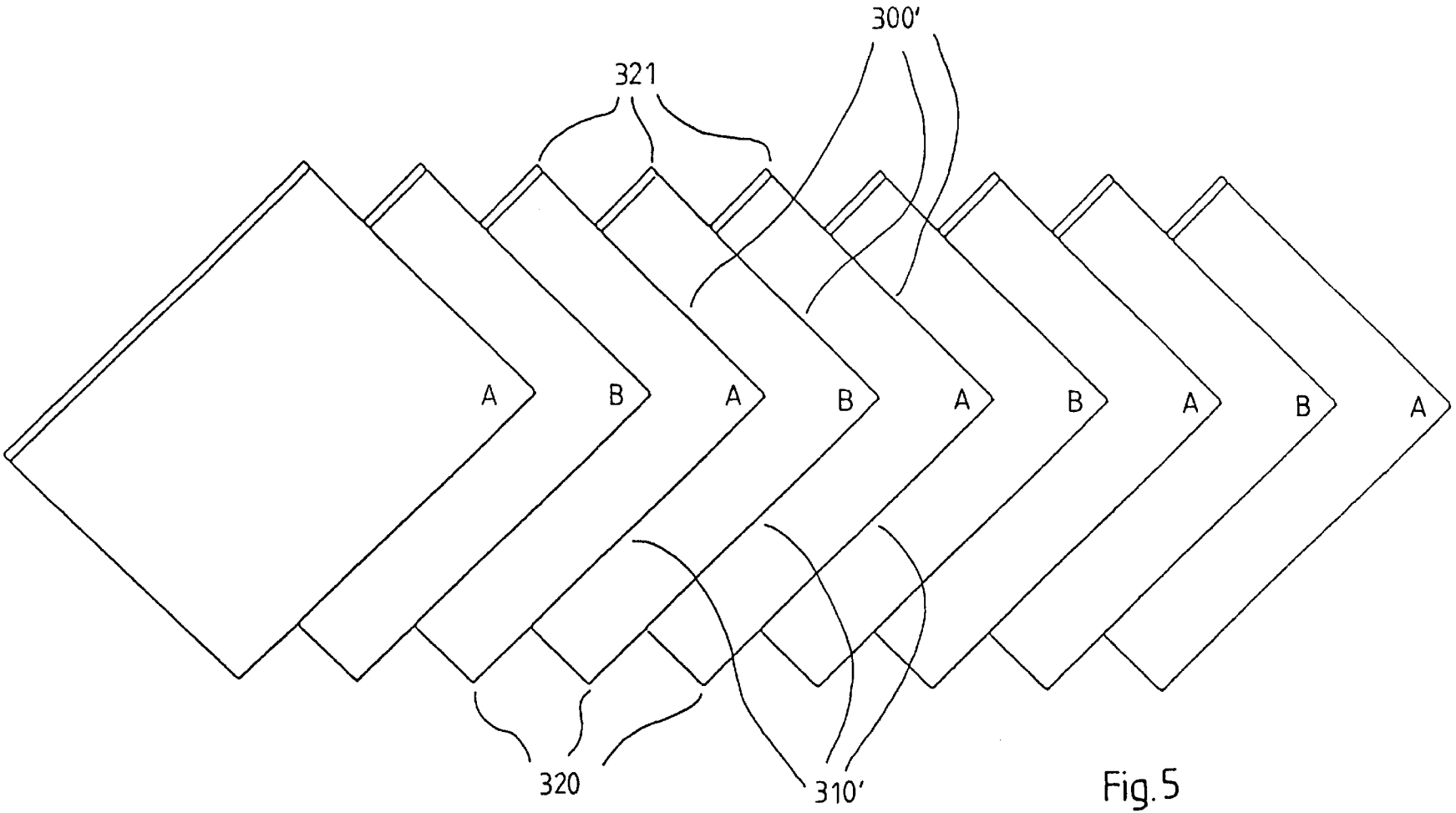
FIG. 5 is a view of a shingled product stream in which each signature has been rotated into the leading corner configuration according to the present invention.

FIG. 5 shows a product stream in which all signatures in the initial product stream are rotated 45 degrees into a leading corner configuration according to the present invention. The stream does not have to be selectively rotated as in FIG. 4(*a*). Thus, in FIG. 5, both the A-grippers 17 and the B-grippers 18 are rotated around the axis 20, thereby leaving the shingled formation of the product stream. The advantageous arrangement of the exposed opposed corners 320, 321 can be seen in FIG. 5, as well as the newly configured side edges 300', 310'. The A-angle configuration advantageously provides easy access to the exposed opposed corners 320, 321, and the side edges 300', 310' for such procedures as gripping with a further gripper/conveyor mechanism above and below the signatures. The A-angle configuration thus facilitates gripping individual signatures of any imbricated product stream, a task that is more difficult in a standard leading edge type configuration, even when individual signatures are gripped at locations other than a corner of the signature. Transporting the product stream at an A-angle also provides improved aerodynamic, mechanical and dynamic effects, thereby minimizing the lift and distortion of the signatures during transport.

Figure 6:
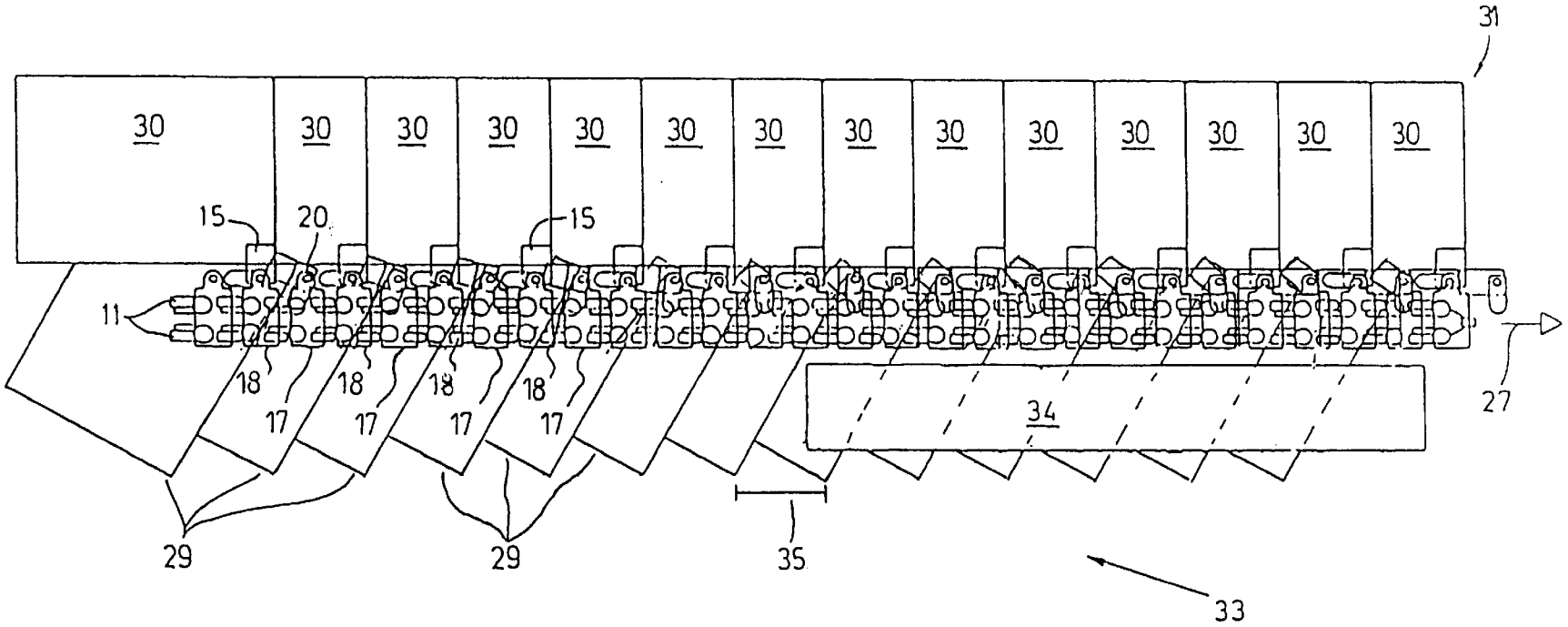
FIG. 6 is a view of a positive control mechanism according to the present invention for generating a fixed pitch in a released secondary product stream.

FIG. 6 shows a positive control mechanism 34 for maintaining a fixed pitch and proper product alignment after release of, for example, the products 29 from the grippers 10. After rotation, products 29, 30 are conveyed on respective sides of the conveying path at a fixed pitch 35. After the selective rotational movement is completed, control of the rotated products 29 can be transferred to a positive control mechanism 34. The positive control mechanism 34 may, for example, include a set of belts which are located on the side of the conveying track to which the rotated products 29 are moved. Once the products 29 enter the positive control mechanism 34, the products are released by the grippers 17 at a fixed pitch 35. Thus, according to the present invention an initial stream of products can be split into two separate product streams having a defined pitch 35, and release of products 29, 30 at different release stations can be accomplished. Since the first and the second sets of grippers 17, 18 are coupled to each other in an endless configuration, a continuous delivery of products 29, 30 on both sides of the conveying path can be maintained.

Additionally, a product stream, for which both the A-grippers 17, and the B-grippers 18 have been rotated 45 degrees, such that the entire stream is oriented in the A-angle configuration, can be easily separated downstream by further processing because of the advantageously accessible exposed opposed corners, and the exposed portions of the side edges. Further processing may include, for example, additional gripper/conveyor mechanisms.

Figure 7:
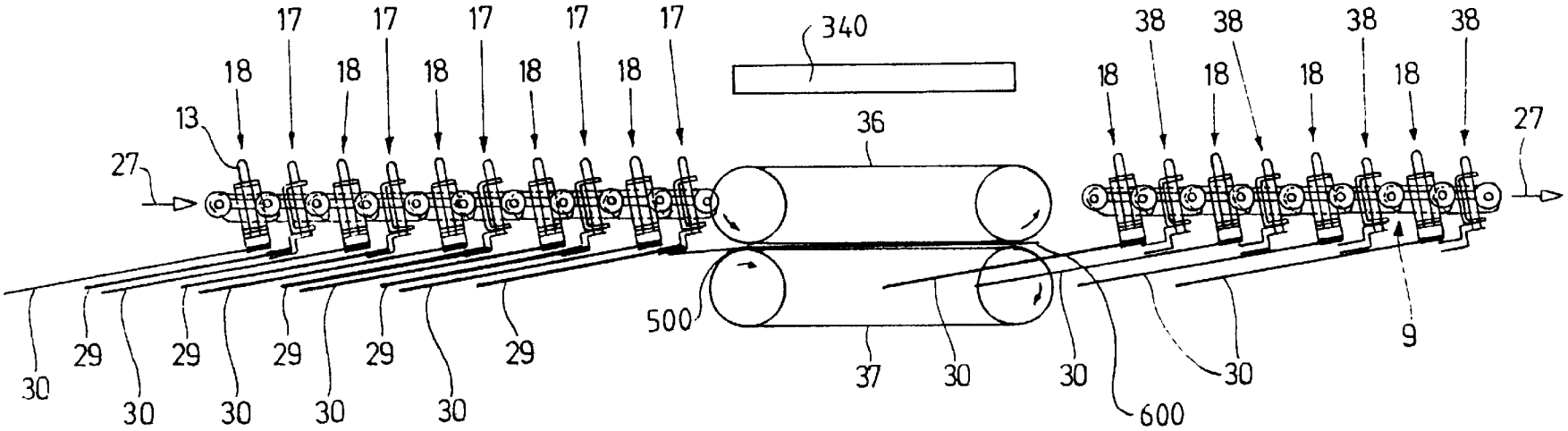
FIG. 7 shows the positive control mechanism of FIG. 6 in greater detail, as well as the plurality of grippers before and after product release.

In FIG. 7, a side view of the conveying belt 9 is shown, including the positive control mechanism 34 to which the rotated products 29 are released. The positive control mechanism 34 includes, for example, a pair of rotating belts 36, 37 driven by cylinders to form an entrance nip 500 and an exit nip 600. As described above, the conveying belt 9 includes A-grippers 17 fixing products 29, and B-grippers 18 fixing products 30, the A-grippers 17, the B-grippers 18, or both, being selected for rotation, thereby splitting the product stream into at least two different streams. Referring to FIG. 7, the A-grippers 17 with products 29 have been rotated 45°, the grippers 17 being shown in their side view. The B-grippers 18, however, remain substantially in their original position holding the products 30, and, therefore, only the back portion of the B-grippers 18 are shown. As described above, however, the B-grippers 18 with products 30 also can be rotated.

As described above, for example, the selected products 29 are released from the respective A-grippers 17 after they are engaged by the upper and lower belts 36, 37. On the other hand, the products 30 remain substantially in their original position and are further conveyed in conveying direction 27 (i.e., the B-grippers 18 are not rotated). Release of the selected products 29 from the A-grippers 17 is accomplished, for example, by pressing the first actuating pin 13 with an actuating mechanism 340. Once released, the A-grippers 17 have now become empty grippers 38 to be conveyed along the conveying path 4. By means of the upper and lower belts 36, 37, the products 29 are inserted into journals or the like, or are delivered to bindery or other finishing devices (not shown). Further along on the conveyer path 4, the remaining products 30 may be retrieved from a second set of conveyer belts and another actuating mechanism 340 and then sent to separate finishing devices, so that the printed product stream is split effectively without loss of a fixed pitch.

Figure 8:
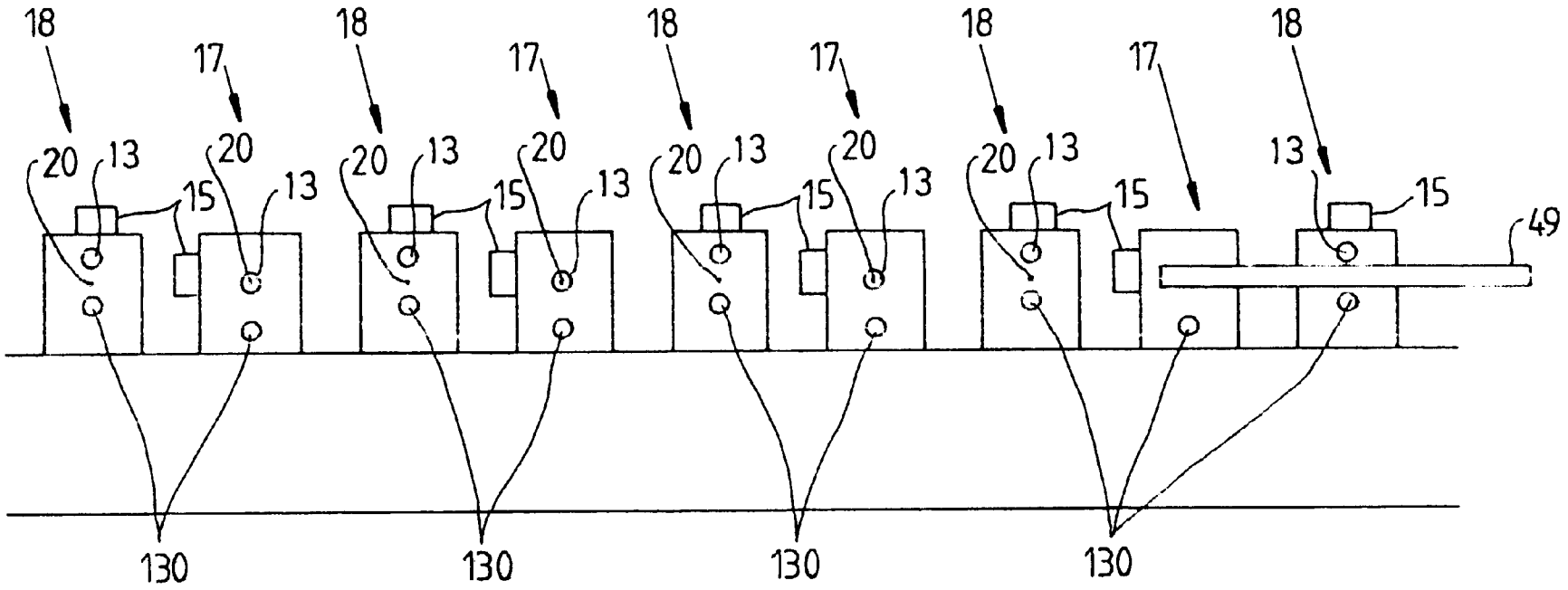
FIG. 8 shows a top view of the conveying belt and a first embodiment of an actuating mechanism for releasing products from the grippers of the conveying belt according to the present invention.

Actuation of the actuating pins 13, 130 by the actuating mechanisms 340 can be accomplished in a variety of ways. For example, referring to FIG. 8, the position of the actuating pin 13 on the A-grippers 17 can be provided on a different plane than the actuating pin 13 on the B-grippers 18. The actuating mechanisms 340 can be formed as an actuating bar 49 positioned in the appropriate plane for releasing products from either the A-grippers 17 or the B-grippers 18. Referring to FIG. 8, when the A-grippers 18 reach the actuating bar 49, their respective actuating pins 13 contact the actuating bar 49, thereby causing a downward movement of the moveable portion 23 of the gripper head 15, and a release of the products 29. In contrast, since the actuating pins 13 of the B-grippers are not in the same plane as the actuating bar 49, the products 30 are not released. In order to release the products 30, an actuating bar is placed in the appropriate plane at the desired location along the conveying path 4. Triggering of the actuating pins 130 can be accomplished in the same manner.

Figure 9:
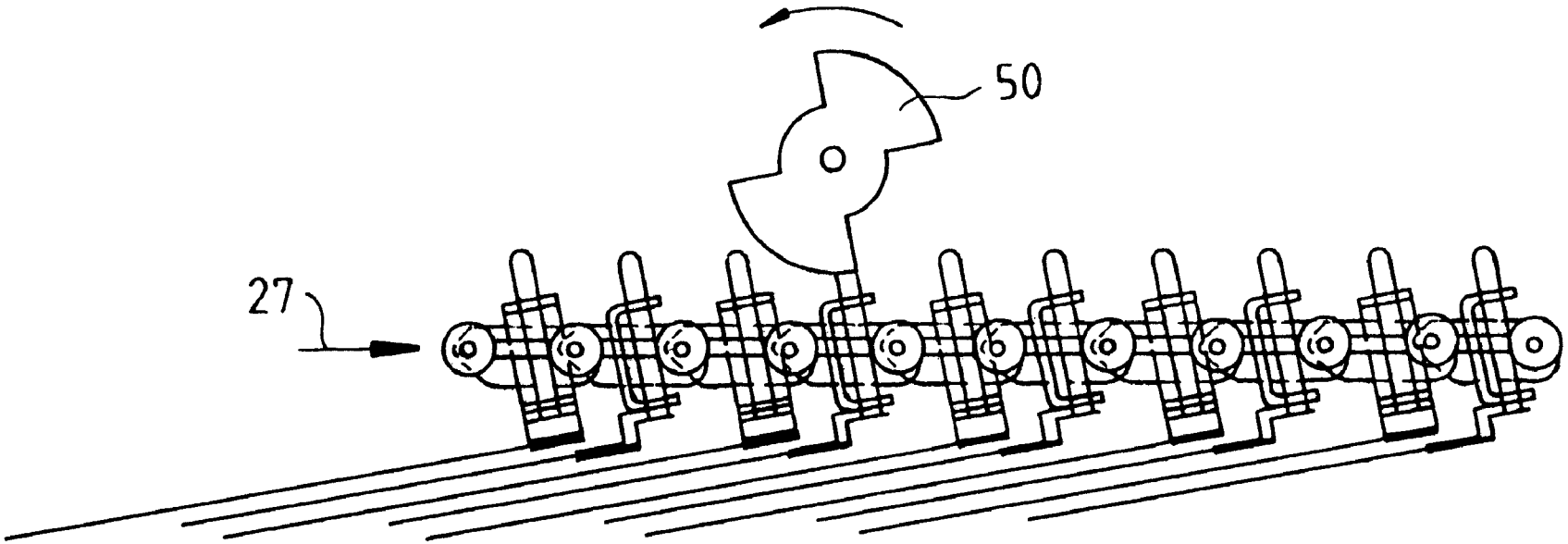
FIG. 9 shows a side view of the conveying belt and a second embodiment of an actuating mechanism for releasing products from the grippers of the conveying belt according to the present invention.

Release or rotation of the products 29, 30 can also be accomplished in other ways. For example, if both the A-grippers 17 and B-grippers 18 are identical, a notched wheel 50 can be placed over the conveyor path 5 as shown in FIG. 9. By properly initializing the wheel, and synchronizing the rotation of the wheel to the conveying speed of the conveyer belt 9, rotation or release of either the A-grippers 17 or the B-grippers 18 can be accomplished. As described in co-pending application Ser. No. 08/349,110, entitled "Device For The Release Of Folded Products" filed on Dec. 2, 1994, the specification of which is hereby incorporated by reference, a release module can be used to release or rotate the desired products.

Figure 10:
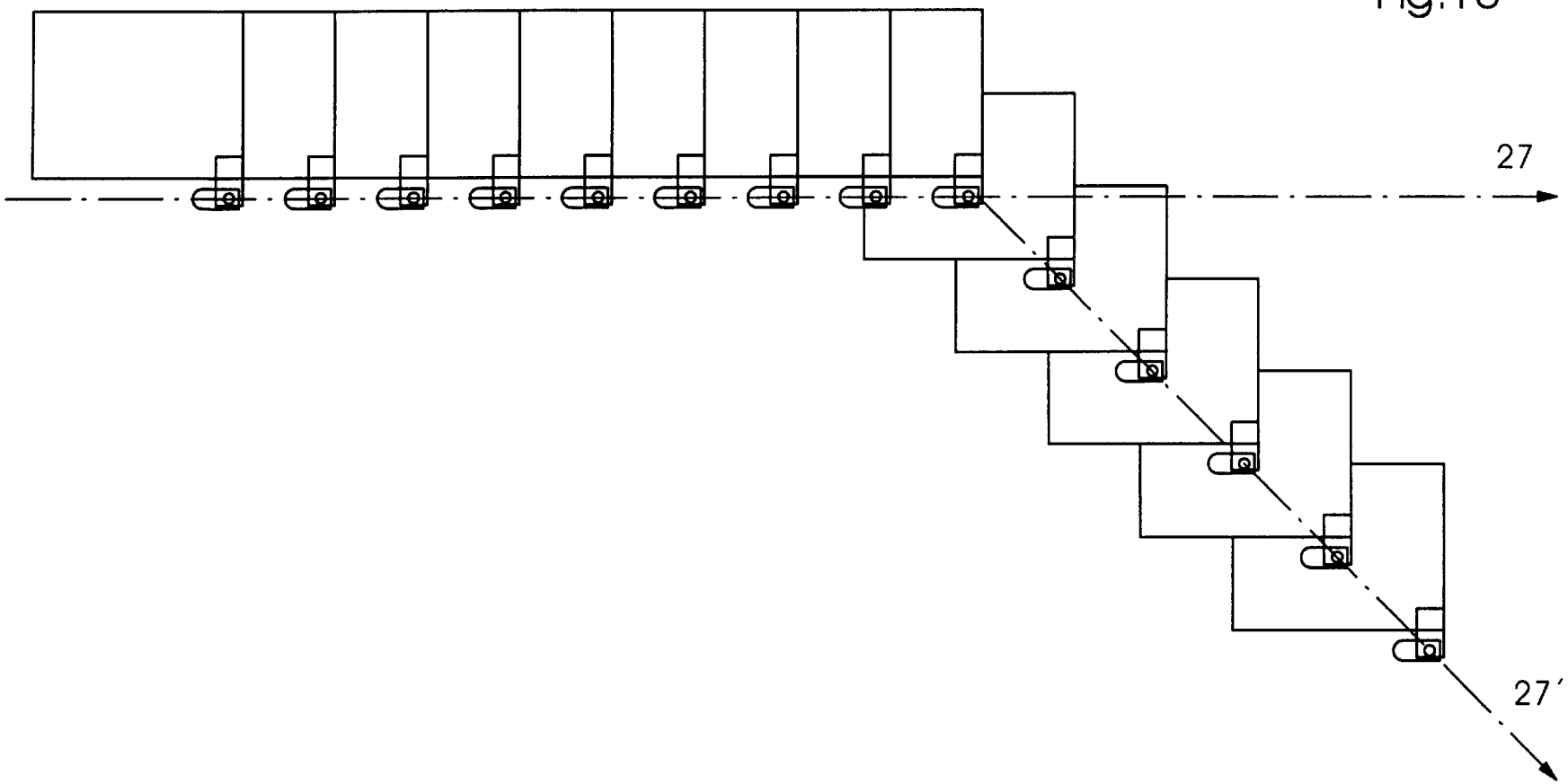
FIG. 10 shows a product stream converted from edge leading to corner leading according to another embodiment of the present invention.

FIG. 10 shows how a stream may be changed to a leading corner or A-angle configuration by a change in direction of the conveying path according to the present invention. For example, a corner of the leading edge configuration is gripped while the product stream proceeds in conveying direction 27. The conveyor path then changes direction by, for example, approximately 45 degrees to a new conveying direction 27'. The product stream is thereby converted to a leading corner configuration and may be transported in accordance with the present invention with reduced aerodynamic, mechanical, and dynamic disturbances to reduce lift and distortion during transport. One of skill in the art will recognize that a means of selectively diverting grippers from the conveying direction 27 to the new conveying direction 27' will allow the product stream to split into two separate product streams, for example, a first set of grippers continuing in a leading edge configuration in conveying direction 27 and a second set of grippers proceeding in a leading corner configuration in new conveying direction 27'.

Figure 11:
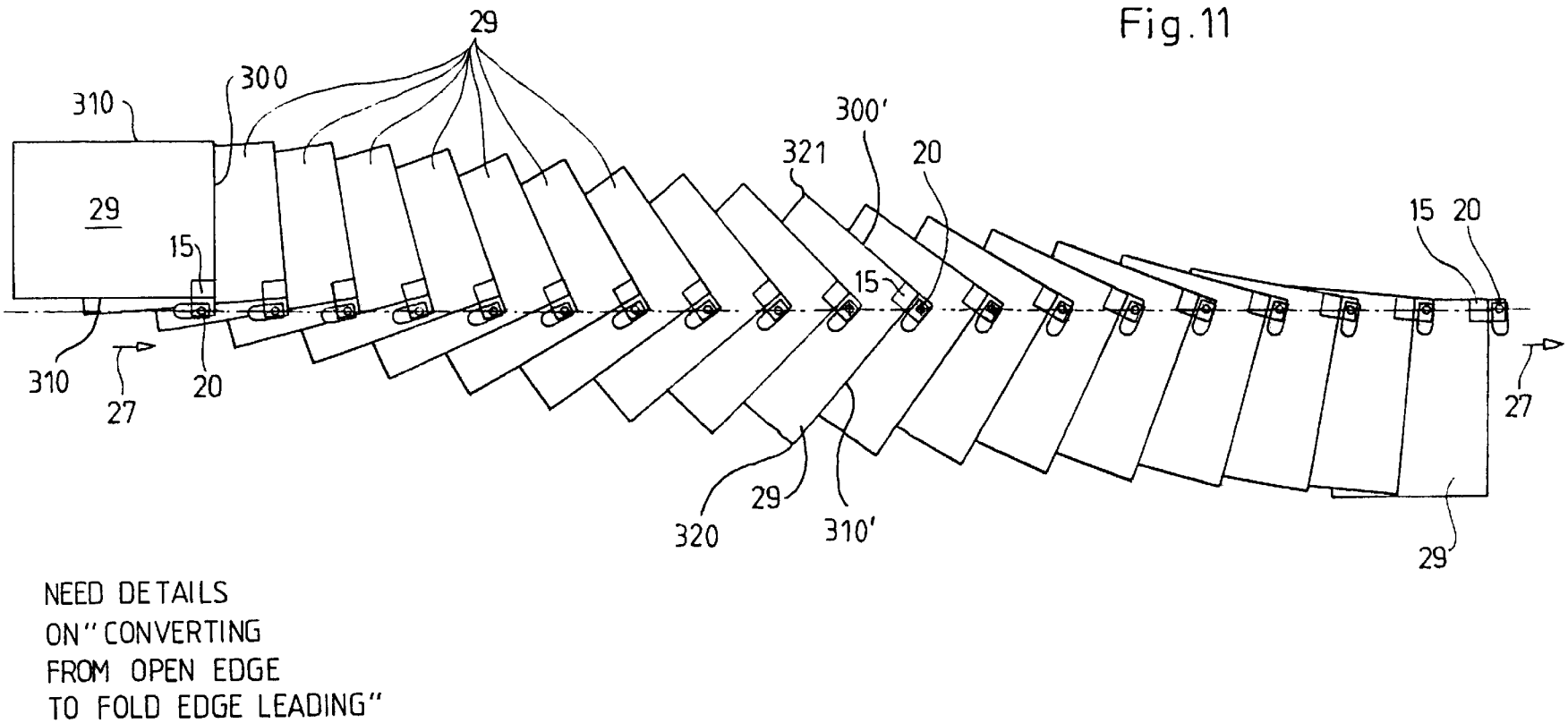
FIG. 11 shows an exemplary use of the present invention whereby a product stream is converted from an open edge leading to a fold edge leading configuration.

As shown in FIG. 11, the A-angle configuration allows convenient access to the stream of signatures to change the stream from, for example, an open edge leading to a fold edge leading configuration, as may be desired for signature processing. For example, once the gripper 17, 18 seizes each signature by the corner and provides a leading corner configuration for the product stream, it is then possible for easy access by a second gripper conveyer to further grip the signatures along the exposed opposed corners or exposed edges. Furthermore, by gripping and rotating the signature, for example, a second 45° rotation, a fold edge leading configuration can be attained.

While the present invention is capable of various modifications and alternate constructions, it is not intended to limit the invention to the specific embodiments disclosed herein. Rather, it is intended to cover all modifications and alternative constructions falling within the spirit and scope of the invention as expressed in the claims.

What is claimed is:

1. An apparatus for conveying a product stream, comprising:

a conveying belt; and a plurality of grippers attached to the conveying belt, each of the plurality of grippers gripping a respective product of the product stream and conveying the product stream in a conveying direction, at least one of the plurality of grippers rotating its respective product so as to convey the rotated product in a repetitive A-angle configuration.

2. The apparatus as recited in claim 1, wherein the repetitive A-angle configuration provides that a frontal edge of the rotated product is disposed at an angle in the range of approximately 30 to 60 degrees relative to a line perpendicular to the conveying direction.

3. The apparatus as recited in claim 2, wherein the repetitive A-angle configuration provides that a frontal edge of the rotated product is disposed at an angle of approximately 45 degrees relative to the line perpendicular to the conveying direction.

4. The apparatus as recited in claim 1, wherein the at least one of the plurality of grippers has a rotatably mounted gripper head.

5. The apparatus as recited in claim 1, wherein every other product of the product stream is selectively moved to a repetitive A-angle configuration by a respective one of the plurality of grippers.

6. The apparatus as recited in claim 1, wherein each of the plurality of grippers includes a gripper head connected to a support, successive supports of the plurality of grippers being linked to one another to form the conveying belt.

7. The apparatus according to claim 4 wherein the rotatably mounted gripper head rotates between a first position and a second position and the at least one of the plurality of grippers has an actuating pin mounted thereon, a spring linked to the actuating pin and the gripper head, the spring held in tension in the first position, the spring released from tension upon triggering of the actuating pin, thereby causing rotation of the gripper head into the second position.

8. The apparatus according to claim 4, wherein the at least one of the plurality of grippers further includes a support, the gripper head being rotationally mounted on the support.

9. The apparatus as recited in claim 8, wherein the gripper head is disposed parallel to a longitudinal axis of the support.

10. The apparatus as recited in claim 8 wherein the gripper head has a stationary portion affixed to the support.

11. The apparatus as recited in claim 1, wherein the at least one of the plurality of grippers has a product gripper head having a moveable portion for gripping a product and an actuating pin, the moveable portion being linked to the actuating pin.

12. The apparatus as recited in claim 1, further comprising a positive control mechanism, the positive control mechanism gripping the products from the product stream, each of the plurality of grippers releasing the product after the product has been gripped by the positive control mechanism.

13. An apparatus fox conveying a product stream, comprising:

a conveying belt;

a plurality of grippers attached to the conveying belt, each of the plurality of grippers gripping a respective product of the product stream and conveying the product stream in a conveying direction, at least one of the plurality of grippers rotating its respective product so as to convey the rotated product in a leading corner configuration; and a positive control mechanism, the positive control mechanism including at least one conveyer belt, the positive control mechanism gripping the products from the product stream, each of the plurality of grippers releasing the product after the product has been gripped by the positive control mechanism.

14. An apparatus for conveying a product stream, comprising:

a conveying belt;

a plurality of grippers attached to the conveying belt, each of the plurality of grippers gripping a respective product of the product stream and conveying the product stream in a conveying direction, at least one of the plurality of grippers rotating its respective product so as to convey the rotated product in a leading corner configuration; and a positive control mechanism, the positive control mechanism including a first conveyer belt rotating about a first cylinder and a second conveyer belt rotating about a second cylinder, the first and second cylinders forming a nip, the grippers conveying the products into the nip before releasing the products, the positive control mechanism gripping the products from the product stream, each of the plurality of rippers releasing the product after the product has been gripped by the positive control mechanism.

15. An apparatus for conveying a product stream, comprising:

a conveying belt; and a plurality of grippers attached to the conveying belt, each of the plurality of grippers gripping a respective product of the product stream and conveying the product stream, each of the plurality of grippers rotating its respective product so as to convey the respective product in a respective A-angle configuration.

16. An apparatus for conveying a product stream, comprising:

a conveying belt; and a plurality of grippers attached to the conveying belt, each of the plurality of grippers gripping a respective product of the product stream and conveying the products in a conveying direction, at least one of the plurality of grippers changing the conveying direction wherein a second product stream is thereby conveyed in a repetitive A-angle configuration.

17. A method for conveying a product stream, comprising the steps of:

gripping each product in a product stream;

rotating a predetermined number of products of the product stream into a repetitive A-angle configuration; and conveying the product stream including the products in the repetitive A-angle configuration in a conveying direction.

18. The method according to claim 17, wherein the step of rotating a predetermined number of products includes rotating each product in a range of approximately 30 to 60 degrees about an axis perpendicular to the conveying direction.

19. The method according to claim 17, wherein the step of rotating a predetermined number of products includes rotating each product approximately 45 degrees about an axis perpendicular to the conveying direction.

20. A method for conveying a product stream, comprising the steps of:

gripping each product in a product stream;

rotating each product of the product stream into a repetitive A-angle configuration; and conveying the product stream in the repetitive A-angle configuration in a conveying direction.

* * * * *